US008360731B2

(12) United States Patent
Nash et al.

(10) Patent No.: US 8,360,731 B2
(45) Date of Patent: Jan. 29, 2013

(54) TIP VORTEX CONTROL

(75) Inventors: Timothy C. Nash, East Hartford, CT (US); Andrew S. Aggarwala, Vernon, CT (US)

(73) Assignee: United Technologies Corporation, Hartford, CT (US)

( * ) Notice: Subject to any disclaimer, the term of this patent is extended or adjusted under 35 U.S.C. 154(b) by 557 days.

(21) Appl. No.: 12/631,317

(22) Filed: Dec. 4, 2009

(65) Prior Publication Data

US 2011/0135482 A1 Jun. 9, 2011

(51) Int. Cl.
*F01D 5/14* (2006.01)

(52) U.S. Cl. ..... 416/223 A; 416/DIG. 5

(58) Field of Classification Search ..... 416/223 A, 416/DIG. 5

See application file for complete search history.

(56) References Cited

U.S. PATENT DOCUMENTS 5,277,549 A * 1/1994 Chen et al. ..... 416/223 A
5,286,168 A * 2/1994 Smith ..... 416/193 A
5,352,092 A * 10/1994 Ferleger et al. ..... 416/223 A
5,480,285 A * 1/1996 Patel et al. ..... 416/223 A
5,524,341 A * 6/1996 Ferleger et al. ..... 29/889.7
6,547,524 B2 4/2003 Kohli et al.
6,669,445 B2 12/2003 Staubach et al.
6,709,233 B2 * 3/2004 Haller ..... 415/192
6,932,572 B2 8/2005 Kohli et al.
7,094,034 B2 8/2006 Fukudu et al.
7,195,456 B2 3/2007 Aggarwala et al.
7,581,930 B2 9/2009 Aggarwala et al.
2009/0148299 A1 6/2009 O'Hearn et al.
2009/0162204 A1 6/2009 Aggarwala et al.
2009/0191045 A1 7/2009 Suciu et al.

* cited by examiner

*Primary Examiner* — Igor Kershteyn
(74) *Attorney, Agent, or Firm* — O'Shea Getz P.C.

(57) ABSTRACT

A rotor blade for a gas turbine engine includes an attachment and an airfoil. The airfoil has a stagger angle, a base region, a transition region and a tip region. The stagger angle changes as the airfoil extends between the attachment and a tip. The base region is disposed adjacent to the attachment. The transition region is located between the base and the tip regions. A rate of the change of the stagger angle in the transition region is greater than a rate of the change of the stagger angle in the base region. The rate of the change of the stagger angle in the transition region is greater than a rate of change of the stagger angle in the tip region.

10 Claims, 3 Drawing Sheets

FIG.5A
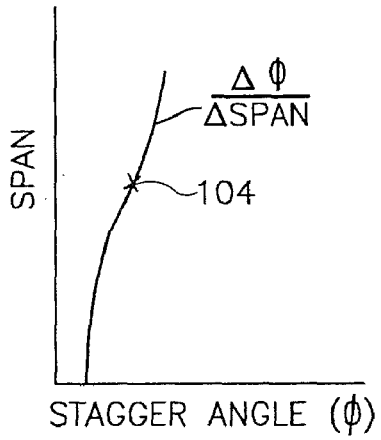
FIG.5B
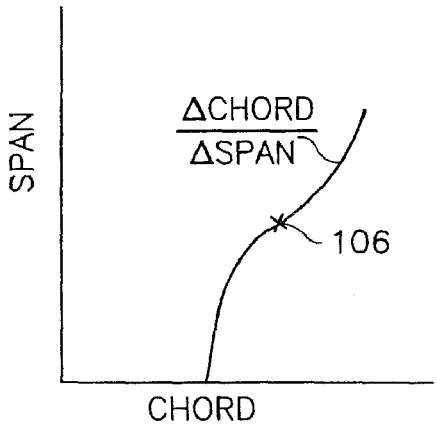
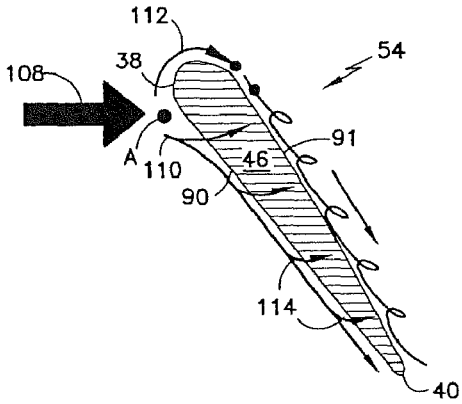
FIG.6
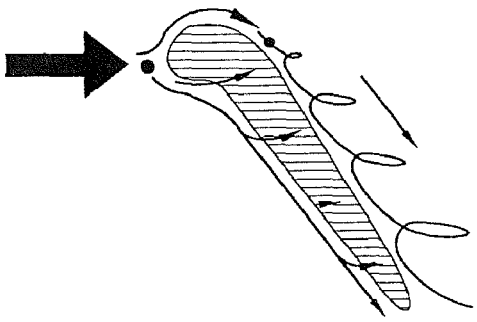
FIG.7
(PRIOR ART)

TIP VORTEX CONTROL

BACKGROUND OF THE INVENTION

1. Technical Field

This disclosure relates generally to gas turbine engines and, more particularly, to rotor blades for gas turbine engines.

2. Background Information

Typically, a rotor blade for a gas turbine engine includes an attachment (also referred to as an "attachment region") and an airfoil. The airfoil extends between the attachment and a tip and has a concaved pressure side surface, a convex suction side surface, a leading edge and a trailing edge. The airfoil is sized such that when it is configured within the engine, a clearance gap is defined between the blade tip and the surrounding static structure (outer flowpath).

During operation, a stagnation point is formed near the leading edge of the airfoil. A stagnation point may be defined as a point in a flow field where velocity of the airflow is approximately zero. At the stagnation point, the airflow separates into a pressure side airflow and a suction side airflow. The pressure side airflow travels from the stagnation point to the trailing edge. The suction side airflow is accelerated around the leading edge and a portion of the suction side surface until it reaches a point of maximum velocity. Typically, the point of maximum velocity corresponds to a point on the suction side surface where the surface becomes relatively flat as compared to a relatively curved portion of the airfoil proximate the leading edge. Thereafter, the suction side airflow decelerates as it travels from the point of maximum velocity to the trailing edge of the airfoil.

Near the tip of the airfoil, a portion of the pressure side airflow (i.e., a leakage airflow) migrates through the tip clearance gap to the suction side airflow. This leakage airflow mixes with the suction side airflow forming a vortex. The vortex mixes out and disperses, causing relatively significant flow disturbances along the majority of the suction side surface. As a collective result of these flow disturbances, the efficiency of the engine is reduced.

Several approaches have been adopted to try to reduce the detrimental effects associated with leakage airflows. In one approach, the clearance gap is decreased by reducing tolerances between the tip of each rotor blade and the outer flowpath. This approach has met with limited success because the tolerances must still account for thermal and centrifugal expansion of materials to prevent interference. In another approach, a shroud is attached to the tips of the rotor blades. Although air may still leak between the shroud and the outer, static flowpath, the vortex induced losses are reduced. A downside to this approach is that a shroud typically adds a significant amount of mass to the rotor, which may limit rotor operational speeds and temperatures.

SUMMARY OF THE DISCLOSURE

According to one aspect of the invention, a rotor blade for a gas turbine engine is provided. The rotor blade includes an attachment and an airfoil. The airfoil has a stagger angle, a base region, a transition region and a tip region. The stagger angle changes as the airfoil extends between the attachment and a tip. The base region is disposed adjacent to the attachment. The transition region is located between the base and the tip regions. A rate of the change of the stagger angle in the transition region is greater than a rate of the change of the stagger angle in the base region. In addition, the rate of the change of the stagger angle in the transition region is greater than a rate of change of the stagger angle in the tip region.

According to another aspect of the invention, a gas turbine engine is provided. The engine includes a compressor section, a combustor section, and a turbine section. The turbine section includes a plurality of rotors having a plurality of radially disposed rotor blades. Each rotor blade includes an attachment and an airfoil. The airfoil has a stagger angle that changes as the airfoil extends between the attachment and a tip, a base region disposed adjacent to the attachment, a tip region, and a transition region located between the base and the tip regions. A rate of the change of the stagger angle in the transition region is greater than a rate of the change of the stagger angle in the base region. In addition, the rate of the change of the stagger angle in the transition region is greater than a rate of change of the stagger angle in the tip region.

BRIEF DESCRIPTION OF THE DRAWINGS

FIG. 5A is a graph illustrating stagger angle rates of change of the airfoil between an attachment and a tip.

FIG. 5B is a graph illustrating chord rates of change of the airfoil between the attachment and the tip.

FIG. 6 is a diagrammatic illustration of airflow characteristics of a tip region of the airfoil in FIGS. 2 and 4.

FIG. 7 is a diagrammatic illustration of airflow characteristics of a prior art rotor blade near a tip thereof.

DETAILED DESCRIPTION OF THE INVENTION

Figure 1:
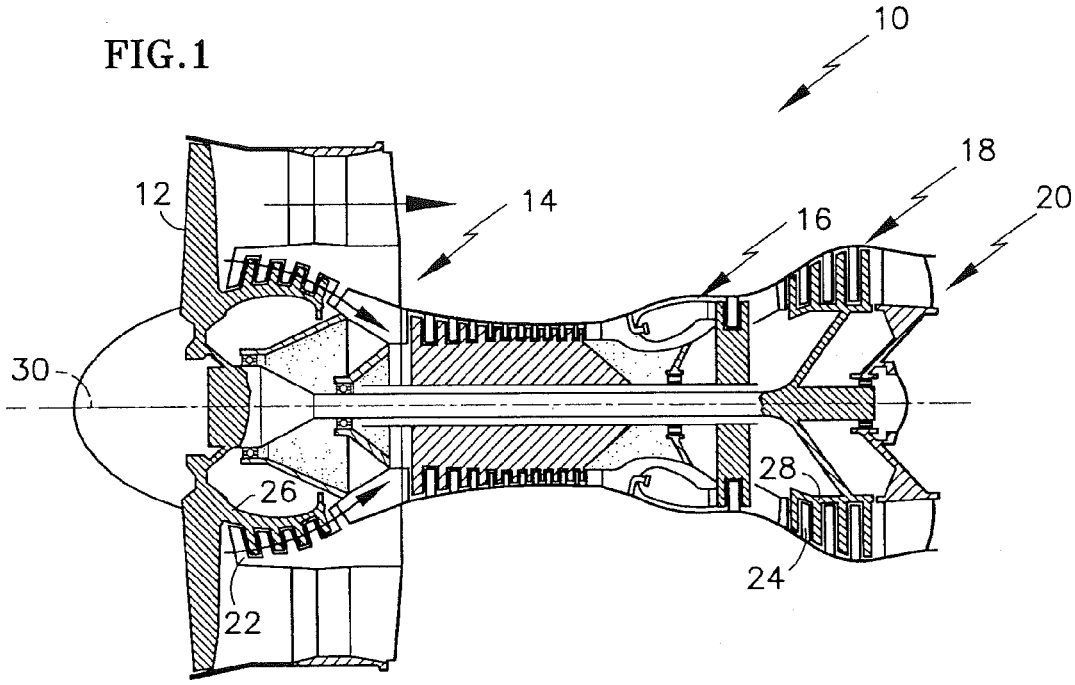
FIG. 1 is a diagrammatic illustration of a gas turbine engine.

Referring to FIG. 1, a gas turbine engine 10 includes a fan 12, a compressor section 14, a combustor section 16, a turbine section 18, and a nozzle 20. The compressor and turbine sections 14, 18 each include a plurality of stator vane stages 22, 24 and rotor stages 26, 28. Each stator vane stage 22, 24 includes a plurality of stator vanes that guide air into or out of a rotor stage in a manner designed in part to optimize performance of that rotor stage. Each rotor stage 26, 28 includes a plurality of rotor blades attached to a rotor disk. The rotor stages 26, 28 within the compressor and turbine sections 14, 18 are rotatable about a longitudinally extending axis 30 of the engine 10.

Figure 2:
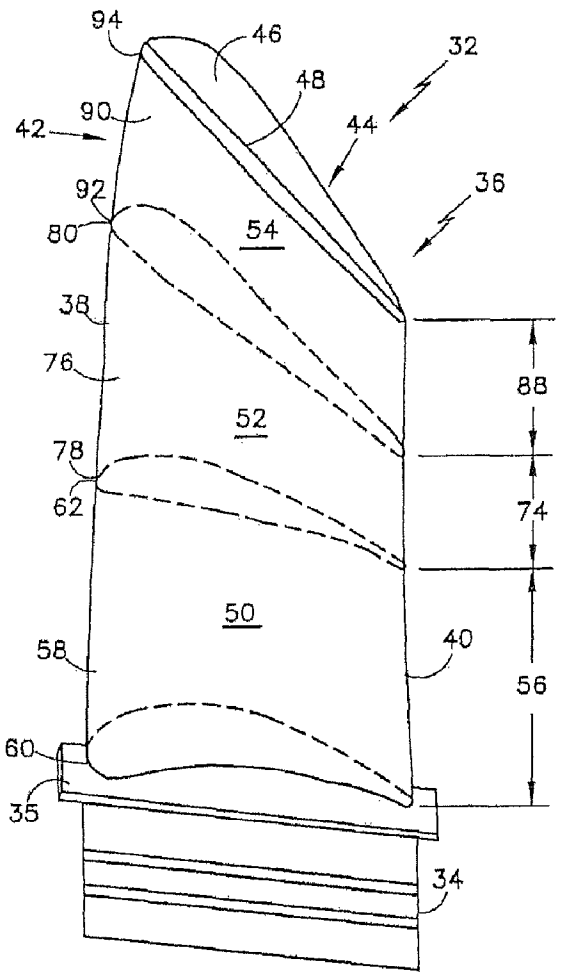
FIG. 2 is a diagrammatic illustration of a rotor blade for the gas turbine engine in FIG. 1.

FIG. 2 is a diagrammatic illustration of one embodiment of a rotor blade 32 for use in the turbine section 18 of the gas turbine engine 10. The rotor blade 32 includes an attachment 34, a platform 35, and an airfoil 36. Some embodiments of the rotor blade 32 do not include the platform 35. To simplify the description herein, the attachment 34 may be considered as including the platform 35 for purposes of defining the beginning of the airfoil 36. The rotor blade attachment 34 is adapted to be received within a slot disposed within a rotor disk. Rotor blade attachments are well known in the art, and the present invention is not limited to any particular attachment configuration.

Figure 3:
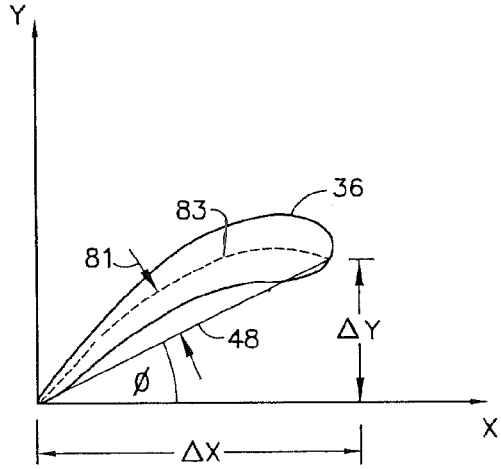
FIG. 3 is a diagrammatic illustration of a cross-sectional slice of an airfoil.

The airfoil 36 has a leading edge 38, a trailing edge 40, a pressure side 42, a suction side 44, a stagger angle $\phi$, a chord and a camber line. The stagger angle q changes as the airfoil 36 extends between the attachment 34 and a tip 46 (e.g., the stagger angle increases in a direction defined by a line that starts at the attachment 34 and travels along the span of the airfoil 36 toward the tip 46). Referring to FIG. 3, the stagger angle $\phi$ is defined as the angle between a chord line 48 of the airfoil 36 and an axis (e.g., the longitudinally extending axis 30 of the gas turbine engine 10, etc.). Therefore, the stagger angle $\phi$ for one cross-sectional "slice" of the airfoil 36 may be calculated using the following equation:

$$\phi_{stagger}=\tan^{-1}(\Delta y/\Delta x)$$

where $\Delta y$ is indicative of a distance between tips of the leading and the trailing edges 38, 40 of the airfoil 36 along a y-axis, and $\Delta x$ is indicative of a distance between the tips of the leading and the trailing edges 38, 40 of the airfoil 36 along an x-axis. Additionally, or alternatively, the chord of the airfoil 36 changes as the airfoil 36 extends between the attachment 34 and the tip 46; e.g., the airfoil chord increases in a direction defined by a line that starts at the attachment 34 and travels along the span of the airfoil 36 toward the tip 46. Referring again to FIG. 2, the airfoil 36 includes a base region 50, a transition region 52 and a tip region 54.

The base region 50 has a base height 56, a pressure side surface 58, and a suction side surface (not shown). The base height 56 extends between a first end 60 (also referred to as a "root") and a second end 62. The root 60 is located at a cross-sectional "slice" of the airfoil 36 where the base region 50 abuts the attachment 34. The second end 62 is located at a cross-sectional "slice" of the airfoil 36 where the base region 50 abuts the transition region 52. In some embodiments, the base height 56 is approximately 50% of the span of the airfoil 36. The root 60 and the second end 62 each have a stagger angle 64, 66, a chord 68, 70 and camber 69, 71. Referring to the embodiment in FIG. 4, the airfoil stagger angle increases within the base region 50 in a direction defined by a line 72 that starts at the root 60 and travels toward the second end 62; i.e., the stagger angle 66 at the second end 62 is greater than the stagger angle 64 at the root 60. Additionally, or alternatively, the airfoil chord increases within the base region 50 in a direction defined by the line 72 that starts at the root 60 and travels toward the second end 62; i.e., the chord 70 at the second end 62 is greater than the chord 68 at the root 60. One or both the stagger angle rate of change and the chord rate of change within the base region 50 may be constant or may vary. Where either one of the stagger angle and the chord rates of change vary, an average stagger angle rate of change and/or an average chord rate of change may be used to respectively define the above referenced rates of change within the base region 50. The pressure side surface 58 is concaved and the suction side surface is convex. In some embodiments, the base region 50 additionally has non-uniform camber. Referring to FIG. 3, camber can be defined as a rise 81 (e.g., distance) between a camber line 83 (also referred to as a "mean camber line") and a chord line 48. For example, referring to the embodiment in FIG. 4, the camber of the base region 50 can decrease in the direction defined by the line 72 such that camber 69 of the root 60 is greater than the camber 71 of the second end 62.

Figure 4:
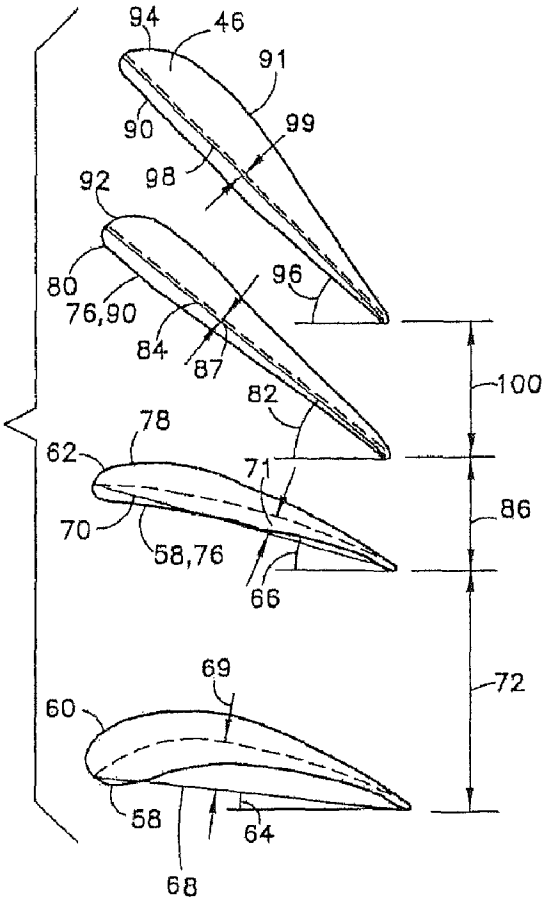
FIG. 4 is a diagrammatic illustration of cross-sectional slices of an airfoil.

Referring to FIG. 2, the transition region 52 has a transition height 74, a pressure side surface 76 and a suction side surface (not shown). The transition height 74 extends between a first end 78 and a second end 80. The first end 78 is located at the same cross-sectional "slice" of the airfoil 36 as the second end 62 of the base region 50. The second end 80 is located at a cross-sectional "slice" of the airfoil 36 where the transition region 52 abuts the tip region 54. In some embodiments, the transition region 52 is approximately 25% of the span of the airfoil 36. The first end 78 and the second end 80 each have a stagger angle 66, 82, a chord 70, 84 and camber 71, 87. Referring to FIG. 4, the airfoil stagger angle increases within the transition region 52 in a direction defined by a line 86 that starts at the first end 78 and travels towards the second end 80; i.e., the stagger angle 82 at the second end 80 is greater than the stagger angle 66 at the first end 78. Additionally or alternatively, the airfoil chord increases within the transition region 52 in a direction defined by the line 86 that starts at the first end 78 and travels toward the second end 80; i.e., the chord 84 at the second end 80 is greater than the chord 70 at the first end 78. One or both of the stagger angle rate of change and the chord rate of change within the transition region 52 may be constant or may vary. Where either one or both of the stagger angle and chord rates of change vary, an average stagger angle rate of change and/or an average chord rate of change may be used to respectively define the above referenced rates of change within the base region 50. The pressure side surface 76 is concaved and the suction side surface is convex. In some embodiments, the transition region 52 additionally has non-uniform camber. For example, the camber of the transition region 52 can decrease in the direction defined by the line 86 such that the camber 71 of the first end 78 is greater than the camber 87 of the second end 80.

Referring to FIG. 2, the tip region 54 has a tip height 88, a pressure side surface 90 and a suction side surface 91. The tip height 88 extends between a first end 92 and a second end 94 (i.e., the tip 46 of the airfoil 36). The first end 92 is located at the same cross-section "slice" of the airfoil 36 as the second end 80 of the transition region 52. In some embodiments, the tip region 54 is approximately 20-25% of the span of the airfoil 36. The first end 92 and the second end 94 each have a stagger angle 82, 96, a chord 84, 98, and camber 87, 99. Referring to FIG. 4, the airfoil stagger angle increases within the tip region 54 in a direction defined by a line 100 that starts at the first end 92 and travels towards the second end 94; i.e., the stagger angle 96 at the second end 94 is greater than the stagger angle 82 at the first end 92. Additionally or alternatively, the airfoil chord increases within the tip region 54 in a direction defined by the line 100 that starts at the first end 92 and travels towards the second end 94; i.e., the chord 98 at the second end 94 is greater that the chord 84 at the first end 92. Notably, one or both of the stagger angle rate of change and the chord rate of change within the tip region 54 may be constant or may vary. Where either one or both of the stagger angle and chord rates of change vary, an average stagger angle rate of change and/or an average chord rate of change may be used to respectively define the above referenced rates of change within the base region 50. The pressure side surface 90 is substantially planar. For example, in one embodiment, a chord line (e.g., the chordline 84, 98) of the tip region 54 is substantially parallel to the pressure side surface 90 between the first and the second ends 92, 94. The suction side surface 91 is generally convex. In some embodiments, the tip region 54 has substantially uniform camber. For example, the camber 87 of the first end 92 may be substantially equal to the camber 99 of the second end 94.

Referring to FIG. 2, the base region 50 is disposed adjacent to the attachment 34. The transition region 52 is located between the base and the tip regions 50, 54. Referring to the embodiment in FIG. 4, the airfoil 36 (i.e., the base, transition and tip regions 50, 52, 54) is configured such that the stagger angle rate of change for the transition region 52 is greater that the stagger angle rates of change for the base and the tip regions 50, 54, respectively. The airfoil 36 is additionally, or alternatively, configured such that the chord rate of change for the transition region 52 is greater than the chord rates of change for the base and the tip regions 50, 54, respectively.

FIG. 5A is a graph illustrating the stagger angle rates of change (i.e., $\Delta\phi/\Delta(\text{span})$) of the airfoil 36 between the attachment 34 and the tip 46. The horizontal axis represents the stagger angle (ϕ) and the vertical axis represents a distance along the span of the airfoil 36. FIG. 5B is a graph illustrating the chord rates of change (i.e., Δ(chord)/Δ(span)) of the airfoil 36 between the attachment 34 and the tip 46. The horizontal axis represents the chord and the vertical axis represents a distance along the span of the airfoil 36. As illustrated in FIGS. 5A and 5B, the transition region 52 has a point of inflection 104, 106 where the curvatures of the lines change from a negative value to a positive value. Significantly, it is believed that this inflection permits the base and the tip regions 50, 54 to have relatively independent airflow characteristics. That is, for example, the airfoil 36 may be configured such that the base region 50 utilizes typical airflow characteristics, while the tip region 54 utilizes airflow characteristics designed to reduce flow disturbances induced by a leakage airflow. The airflow characteristics of the tip region 54 will be described below in further detail.

FIG. 6 is a diagrammatic illustration of the tip region 54 of the airfoil 36 in FIGS. 2 and 4. Referring to FIG. 6, in operation, a stagnation point (e.g., point "A") forms within an airflow 108 adjacent the pressure side surface 90 of the tip region 54 proximate the leading edge 38. As set forth above, a stagnation point may be defined as a point in a flow field where velocity of the airflow is approximately zero. At the stagnation point "A", the airflow 108 is divided into a pressure side airflow 110 and a suction side airflow 112.

The pressure side airflow 110 is directed, parallel to the pressure side surface 90, from the stagnation point "A" towards the trailing edge 40. As the pressure side airflow 110 travels towards the trailing edge 40, a portion thereof (i.e., a leakage airflow 114) migrates over the tip 46 of the airfoil 36 from the pressure side airflow 110 to the suction side airflow 112.

The leakage airflow 114 reduces the efficiency of the turbine via the unrealized work extraction that the leakage air represents and also through increased mixing losses as the leakage air is reintroduced with the mainstream suction side flow. The leakage airflow and the manner in which it mixes upon exiting the tip gap on the suction side are a function of the local pressure distribution around the blade tip. In contrast to prior art rotor blades which aim to reduce the tip leakage, the present invention does not alter the amount of leakage flow. In contrast, it alters the local pressure distribution to one more favorable for reducing the leakage mixing loss. This substantial reduction in mixing loss leads to a higher efficiency turbine.

While various embodiments of the present invention have been disclosed, it will be apparent to those of ordinary skill in the art that many more embodiments and implementations are possible within the scope of the invention. Accordingly, the present invention is not to be restricted except in light of the attached claims and their equivalents.

What is claimed is:

1. A rotor blade for a gas turbine engine, comprising:

an attachment; and an airfoil having a stagger angle that changes as the airfoil extends between the attachment and a tip, a base region disposed adjacent to the attachment, a tip region, and a transition region located between the base and the tip regions;

wherein a rate of the change of the stagger angle in the transition region is greater than a rate of the change of the stagger angle in the base region;

wherein the rate of the change of the stagger angle in the transition region is greater than a rate of change of the stagger angle in the tip region; and wherein the airfoil has a chord that increases as the airfoil extends from the base region to the tip.

2. The rotor blade of claim 1, wherein the tip region has a substantially planar pressure side surface.

3. The rotor blade of claim 1, wherein the tip region has a chord line and a pressure side surface, and wherein the chord line is substantially parallel to the pressure side surface.

4. The rotor blade of claim 2, wherein the chord increases as the airfoil extends from the attachment to the tip.

5. The rotor blade of claim 2, wherein the chord changes as the airfoil extends between the attachment and the tip, wherein a rate of change of the chord in the transition region is greater than a rate of change of the chord in the base region, and wherein the rate of change of the chord in the transition region is greater than a rate of change of the chord in the tip region.

6. The rotor blade of claim 5, wherein the chord of the airfoil increase from the base region to the tip region.

7. The rotor blade of claim 2, wherein airfoil has a span, and wherein the tip region has a height equal to or less than approximately 25 percent of the span.

8. The rotor blade of claim 2, wherein airfoil has a span, and wherein the transition region has a height equal to approximately 25 percent of the span.

9. The rotor blade of claim 2, wherein airfoil has a span, and wherein the base region has a height equal to approximately 50 percent of the span.

10. A gas turbine engine, comprising:

a compressor section;

a combustor section; and a turbine section;

wherein the turbine section includes a plurality of rotors having a plurality of radially disposed rotor blades, each rotor blade including an attachment and an airfoil having a stagger angle that changes as the airfoil extends between the attachment and a tip, a base region disposed adjacent to the attachment, a tip region, and a transition region located between the base and the tip regions;

wherein a rate of the change of the stagger angle in the transition region is greater than a rate of the change of the stagger angle in the base region;

wherein the rate of the change of the stagger angle in the transition region is greater than a rate of change of the stagger angle in the tip region; and wherein the airfoil has a chord that increases as the airfoil extends from the base region to the tip.

* * * * *